United States Patent [19]

Mead

[11] Patent Number: 4,780,723

[45] Date of Patent: Oct. 25, 1988

[54] MICROSTRIP ANTENNA COMPRESSED FEED

[75] Inventor: James B. Mead, Brookside, N.J.

[73] Assignee: The Singer Company, Stamford, Conn.

[21] Appl. No.: 831,586

[22] Filed: Feb. 21, 1986

[51] Int. Cl.[4] ..... H01Q 1/38

[52] U.S. Cl. ..... 343/700 MS; 343/737; 343/853; 333/246

[58] Field of Search ..... 343/700 MS, 824, 813, 343/853, 705, 737; 333/128, 161, 238, 246, 125, 127, 124, 136

[56] References Cited

U.S. PATENT DOCUMENTS 2,903,695 9/1959 Jamieson ..... 343/853

4,180,818 12/1979 Schwartz et al. ..... 343/700 MS 4,302,734 11/1981 Stockton et al. ..... 333/246

4,575,728 3/1986 Theobald et al. ..... 343/815

4,595,891 6/1986 Cronauer ..... 333/128

FOREIGN PATENT DOCUMENTS 3137816 4/1983 Fed. Rep. of Germany ..... 343/700 MS

*Primary Examiner*—William L. Sikes

*Assistant Examiner*—Michael C. Wimer

*Attorney, Agent, or Firm*—David L. Davis

[57] ABSTRACT

A compressed feed is used in a microstrip antenna for reducing the spacing between adjacent tap points on the feed line such that sigma angle changes—due to temperature variations—of a radiating beam in a radar system are reduced.

8 Claims, 3 Drawing Sheets

FIG. 3
(PRIOR ART)
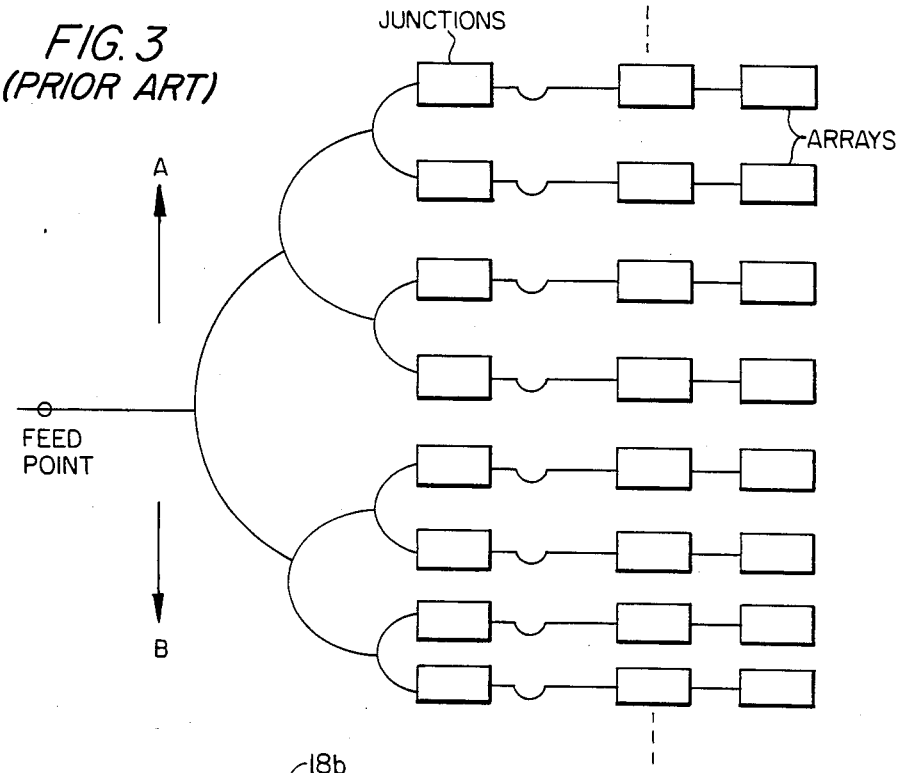
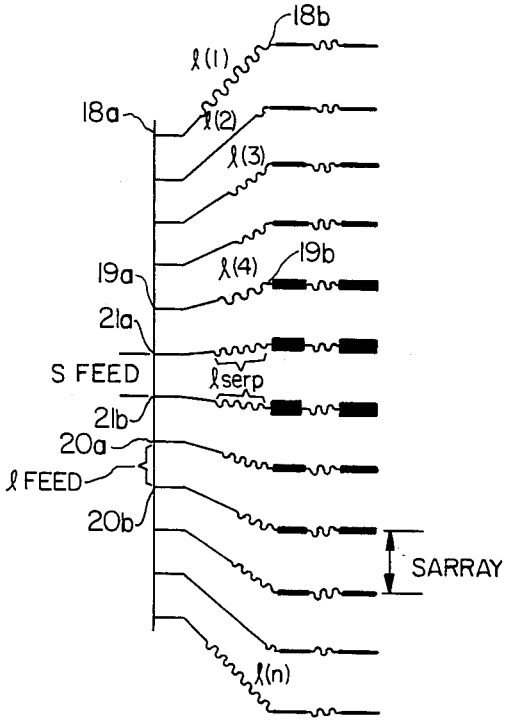
FIG. 4

MICROSTRIP ANTENNA COMPRESSED FEED

BRIEF DESCRIPTION OF THE PRIOR ART

The most relevant known prior art is copending patent application Ser. No. 650,491, now U.S. Pat. No. 4,603,332 to Mead, et al., which is assigned to the present assignee. The prior art antenna is an interleaved microstrip planar antenna which has both forward and backward firing apertures. By using both forward-firing and backward-firing arrays, spacings between the arrays can be chosen in the microstrip antenna for compensating the gamma angle fluctuations, which result from temperature variations, of the radiated beam. However, this interleaved microstrip antenna does not compensate for any sigma angle fluctuations which may be caused by temperature variations.

BRIEF DESCRIPTION OF THE PRESENT INVENTION

The present invention can be used in both single aperture and interleaved dual aperture microstrip antennas. By compressing the tap points of the feed for the arrays, changes due to temperature variations in the sigma angle of the radiating beam of the microstrip antenna are compensated.

Thus, the present invention has the distinct advantage of substantially reducing any sigma angle fluctuations due to temperature variations.

A second distinct advantage of the present invention is that the compressed feed can be applied to both single aperture and dual aperture microstrip antennas.

The above-mentioned objects and advantages of the present invention will be more clearly understood when considered in conjunction with the accompanying drawings, in which:

BRIEF DESCRIPTION OF THE FIGURES

FIG. 3 illustrates a conventional corporate feed;

FIG. 4 illustrates a section of the compressed feed antenna of the present invention.

DETAILED DESCRIPTION OF THE INVENTION

Figure 1:
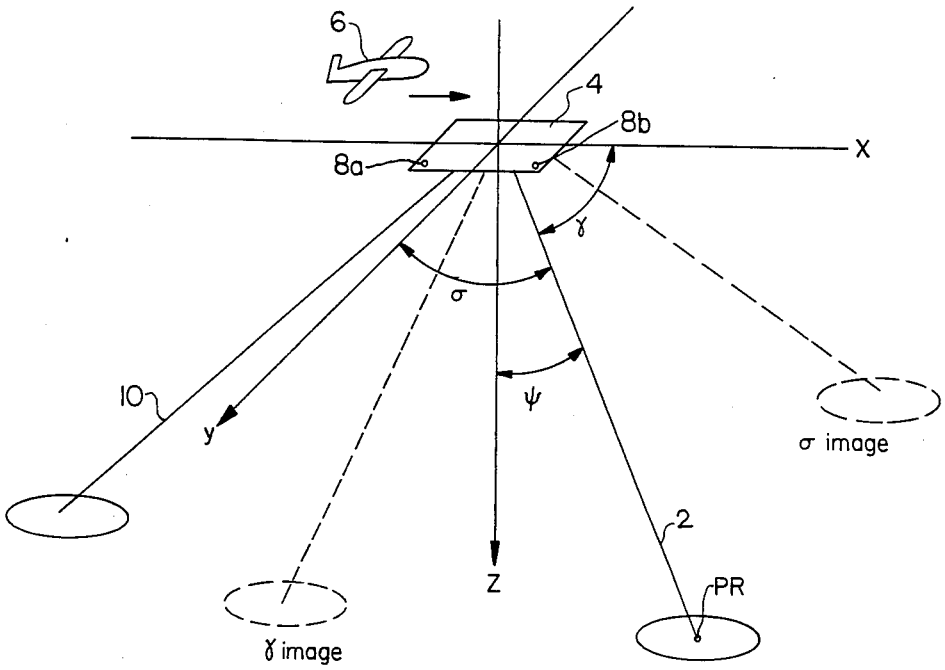
FIG. 1 is a schematic illustration of a typical antenna radiation pattern.

In a microstrip planar antenna for a doppler radar system, there is always a certain degree of error due to temperature changes reacting with the dielectric materials which make up the microstrip antenna apertures. This is due to the fact that the beam angles of the antenna are functions of the temperature. Putting it simplistically, as the temperature increases, the beam angles have a tendency to spread away from each other; and when the temperature decreases, the beam angles would come back toward each other. For example, in FIG. 1 there is shown a typical diagram of a doppler radar system wherein a beam 2 is projected from planar antenna 4 of aircraft 6. As shown in the three-dimensional diagram, the axis of beam 2 is at an angle gamma ($\gamma$) to the x axis, at an angle sigma ($\sigma$) to the y axis, and at an angle psi ($\psi$) to the z axis. From beam 2 two images, gamma ($\gamma$) and sigma ($\sigma$), are reflected back to the antenna. Note that the gamma image is to the back of beam 2 while the sigma image is at the same forward position but to the left of beam 2 in this example. For the sake of clarity, the $\gamma$ image in FIG. 1 is shown at a different position from beam 10, although in reality they are coincident. When there is a temperature fluctuation, the beam angle of beam 2 would be affected as the dielectric materials used for the microstrip antenna would either expand or contract, thereby causing the beam angles to fluctuate. This in turn affects the reflected gamma and sigma images.

In the above-mentioned copending application, a microstrip antenna having forward-firing and backward-firing apertures comprising interleaved arrays is disclosed. By alternately firing the backward and forward apertures via feed points 8*a* and 8*b*, forward beam 2 and backward beam 10, respectively, are projected. As the temperature increases, beam 2 (and a corresponding beam to the left of beam 2 which is omitted for the sake of clarity) will move away from the normal, which is the Z axis, and beam 10 (along with a corresponding beam to the left thereof) will move forward toward the normal. Since there is an averaging effect, the average beam angle to the normal remains fairly constant thereby compensating for any temperature variation that would occur. Yet, this technique would only compensate against changes in the gamma angle, as the gamma angle is related to the forward and backward swings of the beams. Thus, $\gamma$angle changes are compensated for by the interleaved microstrip antenna described in the copending application. Because the sigma angle is related to a doppler system in the y axis, changes due to temperature variations in the sigma angle would not be compensated by the alternate firing of both forward and backward arrays.

Figure 2:
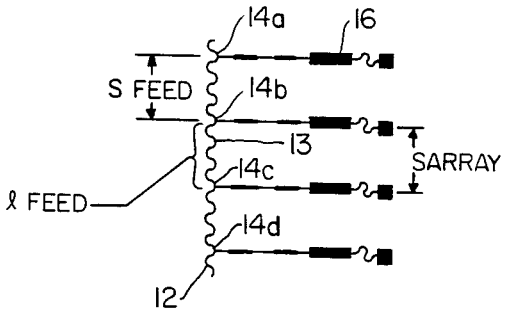
FIG. 2 (PRIOR ART)
FIG. 2 is a typical feed section of a conventional traveling wave feed.

The present invention introduces the concept of compressing the feed line of either a single aperture or interleaved dual aperture microstrip antennas. Compared to a conventional set of antenna arrays, the compressed feed permits smaller feed spacing between the tap points, thereby reducing fluctuations of the sigma angle due to temperature variations. To illustrate, FIG. 2 shows a typical feed section of a conventional antenna aperture. As shown, feed line 12 is tapped into by four arrays 16 at tap points 14*a*–14*d*. The spacing between adjacent tap points, for example, between tap points 14*a* and 14*b*, is designated as sfeed. Lfeed designates the actual length a traveling wave has to transverse between two adjacent tap points, in this instance tap points 14*b* and 14*c*. The spacing between the two arrays is designated by sarray. As temperature increases, like most materials, serpentine section 13, as well as the physical spacing of adjacent arrays, sarray, physically expand. The dielectric constant ($E_r$) of the material making up serpentine section 13, i.e., the feed line, also changes. Hence, changes in the length of serpentine section 13, the spacing of arrays 16, and the dielectric constant $E_r$ of the material making up serpentine section 13 contribute to the change in the beam angle. This is shown by Equation 1:

$$\cos\sigma = \frac{(\text{lfeed} \times \sqrt{E_r} - \lambda_0)}{\text{sarray}} \qquad \text{Eq. 1}$$

where $\lambda_0$=the free space wavelength and $\sigma$ = the angle as measured from the y axis to the beam peak.

As shown by Equation 1, it can readily be seen that the beam angle is a function of the square root of dielectric constant $E_r$, a function of lfeed, which corresponds to the actual path length of serpentine section 13 (for this example), and is a function of sarray.

A previous method used for compensating changes in the sigma angle due to temperature variations is by means of a corporate feed, which is shown in FIG. 3. However, unlike a traveling wave feed, the corporate feed can send out a radiating beam only in the designated A or B direction of FIG. 3, but not both (the traveling wave feed produces beams at $\sigma$ and the supplement of $\sigma$ when fed from opposite ends). Corporate feeds are impractical for Doppler radar antennas since four feeds would be necessary to generate the four beams. Only two traveling wave feeds are necessary since each generates two beams.

As noted previously, when temperature increases, the dielectric material in a typical microstrip antenna expands. This causes not only a change in $E_r$, but also an increase in the spacing between adjacent arrays and adjacent tap points on a feed line. As a result, there is also an increase in the path length, lfeed, where the feed line is serpentine shaped. The relationship between the rate of change of $\sigma$ with temperature and $E_r$, sarray and lfeed are shown hereinbelow.

$$\frac{d\sigma}{dt} = \frac{(\text{lfeed/sarray}) \times \sqrt{E_r} \times \alpha e}{2 \times \sin\sigma} - \frac{\lambda_0 \times \alpha s}{\text{sarray} \times \sin\sigma} \qquad \text{Eq. 2}$$

where $\alpha e$ = the fractional change in dielectric constant versus temperature = −0.000485 part per degree C. for Teflon-fiberglass and $\alpha s$ = the fractional change in spacing, sfeed, versus temperature = 0.000127 part per degree C., for the Teflon-fiberglass on aluminum ground plane.

In general, the first term of Equation 2 dominates the second term. Thus, if it were possible to reduce the magnitude of the first term, then the rate of change of sigma angle in terms of temperature, i.e., $d\sigma/dt$, would also be reduced. One way to achieve this is to reduce lfeed while keeping sarray constant. The fraction (lfeed/sarray) in the first term of Equation 2 is obviously reduced in this case and $d\sigma/dt$ is also reduced. Based on this principle, a feed configuration with reduced lfeed is shown in FIG. 4. A straight feed line is shown in FIG. 4. It should be noted that a straight line is not required in a compressed feed, it is done in this instance only for the sake of simplicity, as the straight line can very well be replaced by a serpentine one. In this case it is obvious that lfeed, for example shown between 20*a* and 20*b*, is significantly less than sarray and that spacing sfeed between tap points 21*a* and 21*b* has the same length as lfeed, as a straight feed line is used herein; where in the case of the standard feed of FIG. 2, lfeed is obviously greater than sarray.

Lfeed is related to sarray and $E_r$ as follows.

$$\text{lfeed} = \frac{(\text{sarray} \times \cos\sigma + \lambda_0)}{\sqrt{E_r}} \qquad \text{Eq. 3}$$

As lfeed is actually shorter than the spatial distance between two adjacent arrays, designated as sarray in FIG. 4, lfeed is actually compressed.

Given Equations 1 and 3 and supposing the following numbers are given:

$\sigma$ angle = 73°—standard feed, $\sigma$ angle = 107°—compressed feed, sarray = 0.64

$E_r$ = 2.255, and $\lambda_0$ = 0.8854 calculation of Equation 1—using these numbers—will yield a $d\sigma/dt$ = 0.0138° per degree Centigrade for the conventional type of microstrip antenna shown in FIG. 2, while a $d\sigma/dt$ of 0.0053 is calculated for the compressed feed microstrip antenna of the present invention. Hence, it is known that the present invention has a factor 2.6 better than the conventional type of feed design. Although a sigma angle of 73° is used for the standard feed, an angle of 107° (the supplement of 73°) is used for the compressed feed. Thus, for the standard feed, beam 2 is generated by energizing the left-hand end of the feed, while for the compressed feed, beam 2 is generated by energizing the right-hand end of the feed line.

In order for the compressed feed to function properly, the electrical connecting link, designated as l(n) in FIG. 4, must be equal for all arrays. Yet, looking at FIG. 4, it can readily be seen that the link l(1) between points 18*a* and 18*b* is different from l(4) between points 19*a* to 19*b*. If the different distances of the connecting links l(n) are not adjusted, different phase shifts from these connecting links would be generated. To remedy this, it is imperative that each one of the connecting links would have the same electrical length. Thus, additional links of lines are added to the connecting links, for this example, in the form of serpentine lines designated as lserp in FIG. 4. It should be noted that other forms of squiggley lines can be used instead, provided that the wavelengths of the different connecting links are multiple integers of each other. This can be done by the following equation, which utilizes connecting links l(1) and l(4) as examples.

$$l_{18a\text{-}18b} = l_{19a\text{-}19b} \pm n \times \lambda_E \qquad \text{Eq. 4}$$

where n = 1, 2, 3, . . . ;

$l_{18a\text{-}18b}$ = length of any one path link in antenna;

$l_{19a\text{-}19b}$ = length of any other path link; and $\lambda_E$ = substrate wavelength.

Figure 5:
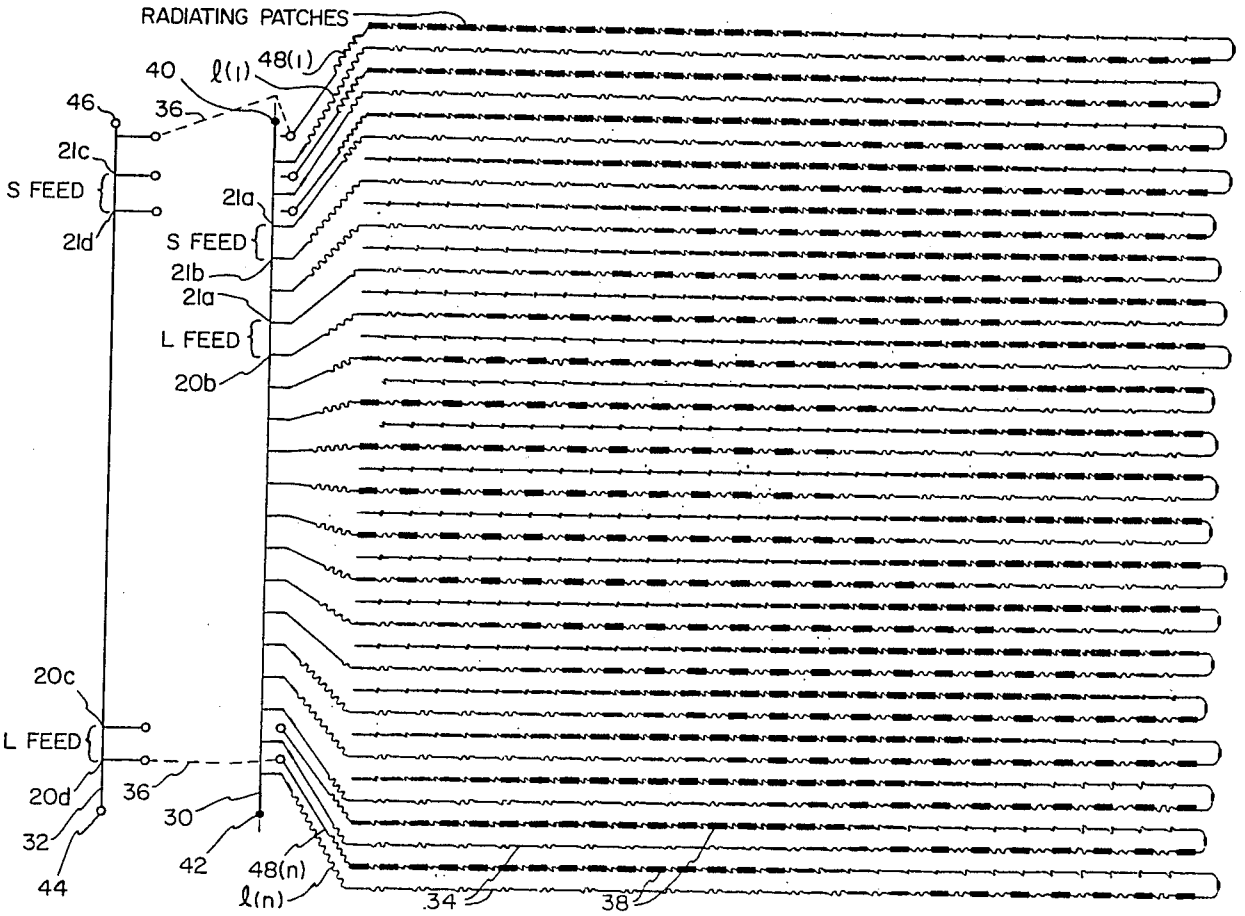
FIG. 5 illustrates the entire radiating plane of the present compressed feed antenna.

Equation 4, states that, if the lengths of all of the connecting links are equal to a known length l of a single connecting link, for example l(4) between points 19*a* and 19*b*, ±an exact substrate wavelength, the antenna of the present invention will function properly. An illustration of the entire radiating plane of the present invention is shown in FIG. 5, wherein only one feed line is shown. It should be noted that a second feed line, which is necessary for the operation of the interleaved arrays microstrip antenna shown in FIG. 5, is only partially drawn in the figure for sake of clarity.

For example, following the nomenclature used in the disclosure from the aforenoted '332 patent, FIG. 5 shows a first feed line 30 and a second feed line 32. Connected to first feed line 30 is a plurality of forward firing arrays 34 while connected to second feed line 32, via dotted lines 36 in a conventional manner for an interleaved microstrip antenna, is a plurality of rear firing arrays 38. As was disclosed in the '332 patent, a first beam may be generated when power is fed to feed point 40; a second beam may be generated when power is applied to feed point 42; ditto, third and fourth beams may be generated when power is respectively applied to feed point 44 and feed point 46. The beams are generated, of course, when a traveling wave traverses past the radiating patches. In accordance with the instant invention, it should be noted that serpentine connecting links l(1) to l(n) and 48(1) to 48(n) are used to connect feed lines 30 and 32, respectively, to the corresponding firing arrays and that second feed line 32, like first feed line 30, also has tap points (designated 20*c*, 20*d*, 21*c* and 21*d*) and corresponding sfeeds and lfeeds. Furthermore, it should be noted that the compressed feed of the present invention can also be utilized for a single aperture microstrip antenna for reducing the sigma angle changes in a doppler radar system.

While a preferred embodiment of the invention is disclosed herein for purposes of explanation, numerous changes, modifications, variations, substitutions and equivalent, in whole or in part, will now be apparent to those skilled in the art to which the invention pertains. Accordingly, it is intended that the invention be limited only by the spirit and scope of the appended claims.

I claim:

1. A microstrip antenna structure exhibiting improved beam angle temperature stability, comprising:

a plurality of parallel arrays, corresponding to an antenna aperture, positioned in spaced coplanar relation;

a feed means positioned in coplanar transverse relation to the arrays;

a plurality of tap means superposed on the feed means along the length thereof, the spatial distance between adjacent tap means being smaller than the spatial distance between adjacent arrays; and a plurality of linking means, positioned in coplanar relation between the feed means and the arrays, for connecting each successive tap means to a corresponding successive one of the arrays at a first end thereof, the linking means exhibiting identical phase shifts;

whereby fluctuations of the beam angle resulting from temperature variance are significantly reduced, and wherein, for an antenna structure located in a three dimensional space having an x axis, a y axis and a z axis with the antenna structure being positioned coplanarly along the x axis, the distance between successive tap means is related to:

$$\text{lfeed} = \frac{(\text{sarray} \times \cos\sigma + \lambda_0)}{\sqrt{E_r}}$$

where lfeed = the actual path length between adjacent tap means, sarray = the spatial distance between adjacent arrays, $\sigma$ = the angle as measured from the y axis to the beam peak, $\lambda_0$ = free space wavelength, and $E_r$ = dielectric constant for the antenna structure.

2. A microstrip antenna having two antenna apertures and exhibiting a sigma beamwidth, the microstrip antenna comprising:

a plurality of forward-firing arrays located in spaced coplanar relation and corresponding to the first antenna aperture;

a plurality of backward-firing arrays corresponding to a second antenna aperture and positioned in coplanar interleaved relation with the forward-firing arrays;

first feed means positioned in coplanar transverse relation to the forward-firing arrays, the first feed means including a plurality of first tap means superposed thereon, the spatial distance between the adjacent first tap means being smaller than the spatial distance between adjacent forward-firing arrays;

second feed means positioned in transverse relation to the backward-firing arrays, the second feed means including a plurality of second tap means superposed thereon, the spatial distance between the adjacent second tap means being smaller than the spatial distance between adjacent backward-firing arrays;

first plurality of linking means, positioned in coplanar relation between the first feed means and the forward-firing arrays, for connecting each first tap means to a first input of a corresponding successive array of the first antenna aperture, the first linking means exhibiting identical phase shifts; and second plurality of linking means coplanarly, positioned between the second feed means and the backward-firing arrays, for connecting each second tap means to a first input of a corresponding successive array of the second antenna aperture, the second linking means exhibiting identical phase shifts;

whereby sigma beam angle fluctuations resulting from temperature variance are significantly reduced.

3. The microstrip structure set forth in claim 2, wherein the first and second feed means are shaped in the form of a straight line.

4. The microstrip structure set forth in claim 3, wherein the spatial distance between adjacent tap means is equal to the path length between the adjacent tap means.

5. The microstrip structure set forth in claim 2, wherein the first and second feed means are serpentine shaped.

6. The microstrip structure set forth in claim 5, wherein the spatial distance between adjacent tap means is smaller than the path length between adjacent tap means.

7. The microstrip antenna structure set forth in claim 2, wherein the plurality of first and second linking means comprises linking means of different actual lengths embedded in a substrate, the actual length of a first one of the first and second plurality of linking means is related to the actual length of a second one of the corresponding first or second plurality of linking means by the following formula:

$$l_x = l_y + n\lambda_E$$

where $l_x$ = the actual length of the first linking means, $l_y$ = the actual length of the second linking means, n = ±integer, and $\lambda_E$ = substrate wavelength.

8. The microstrip antenna structure set forth in claim 2, wherein, for an antenna structure located in a three dimensional space having an x axis, a y axis and a z axis with the antenna structure being positioned coplanarly along the x axis, the path length between adjacent tap means is related to:

$$\text{lfeed} = \frac{(\text{sarray} \times \cos\sigma + \lambda_0)}{\sqrt{E_r}}$$

where lfeed = path length between adjacent tap means,
sarray = the spacing between adjacent arrays,
$\sigma$ = the angle as measured from the y axis to the beam peak,
$\lambda_0$ = free space wavelength, and
$E_r$ = dielectric constant for the antenna structure.

* * * * *